United States Patent [19]

Kitabayashi

[11] 3,999,499

[45] Dec. 28, 1976

[54] SURFACE VESSEL DRIVEN AND CONTROLLED SUBMARINE CARGO TRANSPORT

[76] Inventor: Seiichi Kitabayashi, No. 919-12, Koshikiya Aza Okuba Ageo, Saitama, Japan

[22] Filed: Aug. 20, 1975

[21] Appl. No.: 606,377

[30] Foreign Application Priority Data

| | | |
|---|---|---|
| Aug. 20, 1974 | Japan | 49-95695 |
| Oct. 30, 1974 | Japan | 49-125700 |
| Oct. 31, 1974 | Japan | 49-132216 |

[52] U.S. Cl. ..... 114/244; 115/6; 114/257

[51] Int. Cl.[2] ..... B63B 21/56

[58] Field of Search ..... 114/.5 T, 16 R, 16 G, 114/16 E, 74 R, 74 T, 235 R, 235 B; 115/6.1, 20

[56] References Cited

UNITED STATES PATENTS

| | | | |
|---|---|---|---|
| 575,907 | 1/1897 | Scheubeck | 114/16 R |
| 3,085,533 | 4/1963 | Goryl et al. | 114/16 R |
| 3,101,066 | 8/1963 | Haselton | 114/16 R |
| 3,105,453 | 10/1963 | Hayes | 114/235 B |

*Primary Examiner*—George E. A. Halvosa
*Assistant Examiner*—Jesus D. Sotelo
*Attorney, Agent, or Firm*—Sughrue, Rothwell, Mion, Zinn & Macpeak

[57] ABSTRACT

A cylindrical tank-like submarine hull acts as a cargo carrier and carries its propulsion element which is power driven through a power supply from a surface vessel through a power transport member interconnecting the surface vessel to the underwater carrier. The member interconnecting the surface vessel and the underwater carrier also carries the control line for steering and submerging of the underwater carrier actuated from the surface vessel.

2 Claims, 6 Drawing Figures

SURFACE VESSEL DRIVEN AND CONTROLLED SUBMARINE CARGO TRANSPORT

BACKGROUND OF THE INVENTION

1. Field of the Invention

The present invention relates to marine transportation systems for transporting cargo, and more particularly, to a marine transportation system in which an underwater cargo carrier is linked to a surface vessel and controlled thereby.

2. Description of the Prior Art

Conventionally, the marine transportation of liquid fuel has been accomplished by so-called tankers and other cargo has been transported by similar surface craft called cargo ships. The size of the tankers and cargo ships has increased as the scale of international trade has grown, and the ratio of cargo quantity to number of crew has increased accordingly. However, since various machines and equipment are located on the decks of such surface craft and are relatively remote from each other, a large crew is required to handle those machines and equipment at one time, so that a relatively large crew is required for the modern tankers and cargo ships.

At the same time, it should be pointed out that conventional tankers and cargo ships due to the utilization of electrical machinery and the like, are themselves inevitably a source of fire, and ship fires are reported daily. Further, the shape and construction of tankers and cargo ships are similar to those of conventional surface cargo craft, even where the cargo such as liquid petroleum fuel has fluidity where it readily accommodates the shape of the container for the same. For these and other reasons, the tendencies for enlarging the hulls of ships has reached the uppermost limits, particularly where such craft are required to pass through canals such as the Panama Canal in worldwide travel.

It is, therefore, an object of the invention to overcome the shorcomings of conventional tankers and cargo ships by providing an improved marine transportation system which is capable of transporting most forms of cargo or liquid petroleum fuel safely and economically.

SUMMARY OF THE INVENTION

The present invention, in the form of the multiple embodiments disclosed herein, takes the form of an underwater or submarine cargo carrier linked to an otherwise conventional surface vessel in which the underwater carrier takes the form of a cylindrical tank-like hull and includes its own propulsion means, a source of power is carried by the surface vessel, and means interconnect the underwater carrier to the surface vessel with such means acting to deliver power from the vessel to the propulsion means of the underwater cargo carrier for driving the cargo carrier independently of and beneath the water which supports the surface vessel.

The underwater cargo carrier is preferably provided with rudder and elevator means as well as ballasting means, and the means interconnecting the power source means of the vessel to the propulsion means of the underwater carrier include control lines for linking the rudder and elevator means of the underwater carrier actuator to control the actuator carrier by the surface vessel.

In one form, the propulsion means for the underwater cargo carrier comprises an electric motor coupled to a propeller shaft, the power source means comprises an engine driven generator within the surface vessel and the interconnecting means comprises an electric cable coupling the generator to the motor. In another form, the propulsion means comprises a propeller mounted to a carrier drive shaft which is mounted axially of the vessel on the bow thereof, the power source means comprises the engine of the surface vessel and the interconnecting means comprises a mechanical shaft and means forming a universal joint connection for said shaft between said vessel and said carrier propeller shaft. In a third embodiment of the invention, said propulsion means comprises a spiral fin fixed to the outer peripheral surface of the cylindrical tank, the power source means comprises the engine of the surface vessel and said interconnection means comprises a mechanical shaft and means forming a universal joint connection between said shaft and the underwater carrier tank itself, such that the tank rotates about its axis driven by said shaft which, in turn, is driven by the surface vessel engine.

DESCRIPTION OF THE PREFERRED EMBODIMENTS

Figure 1:
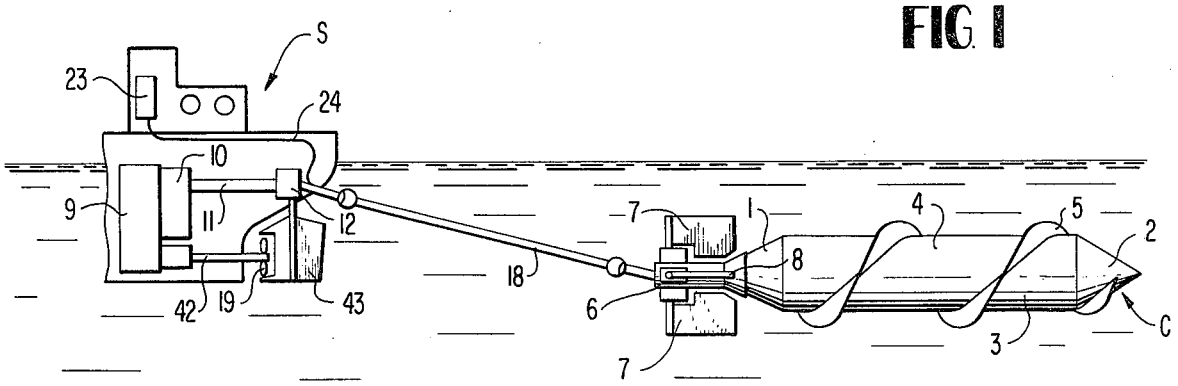
FIG. 1 is a schematic, side elevational view of the embodiment of the marine transportation system of the present invention.
Figure 2:
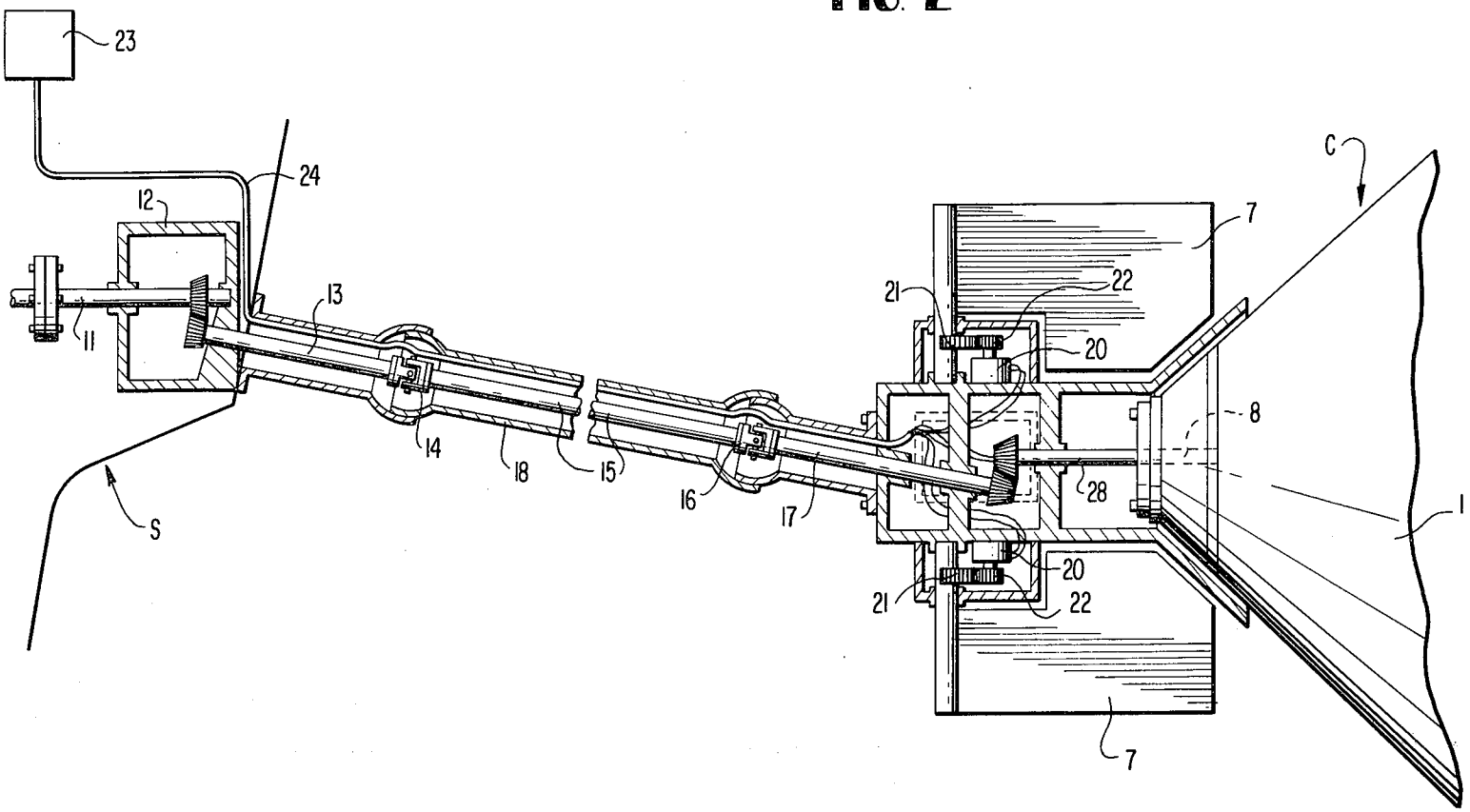
FIG. 2 is a partial sectional view of FIG. 1.

Referring to FIGS. 1 and 2, of the drawings, the underwater cargo carrier indicated generally at C, comprises a sub surface or submarine craft which is mechanically coupled to a surface vessel indicated generally at S, and is driven thereby, this combination forming one embodiment of the present invention. Preferably, the bow 1 and stern 2 of the underwater cargo carrier C is of conical shape and joined by a cylindrical section 4 such that the cargo carrier takes the form of a streamlined tank 3 formed of sheet metal of appropriate marine construction, the conical shape reducing the resistance the tank encounters during fore and aft movement of the same. The tank 3 may be provided with ports (not shown) for loading of fuel oil or similar cargo and manholes (not shown) which are appropriately covered by suitable covers. It is preferable to provide an air tank inside of the cargo carrier to permit the adjustment of the specific weight of the load carrier and to assist in maintaining the cargo carrier C beneath the surface W of water through which the marine transportation system travels. A spiral fin 5 is fixedly secured to the outer peripheral surface of the central tank section 4, the spiral fin extending around the periphery from end to end. An engine output power for rotating the tank 3 is transmitted from an engine 9 of the surface vessel S to the cargo carrier C through a suitable clutch 10, an input gear axle 11 and an output gear axle 13 of a gear box 12, a universal joint 14, an intermediate shaft 15, a universal joint 16, an input gear axle 17 and an output gear axle 28. Between the output gear axle 13 and the input gear axle 17, the universal joints 14 and 16 and the intermediate shaft 15 are accomodated by a sleeve 18 which has spherical universal joints at its corresponding portions to the universal joints 14 and 16.

The engine 9 is further shown as being connected to propeller 19 so that the engine plays the dual role of propelling the tug boat constituting the surface vessel S and rotating the tank 3 of the cargo carrier C. Individual engines may be provided for driving both the surface vessel S and the underwater cargo carrier C. The clutch 10 is provided for permitting the release of the connection automatically when an extraordinally large torque is exerted on the tank 3 by, for example, wave action.

Rudder 7 and 8 are pivotably mounted on nose portion 6 of the cargo carrier C for effecting horizontal and vertical controls of the cargo carrier C, respectively. These are operated by respective motors 20 through respective gears 21 and 22, and the motors 20 are driven by electrical signals supplied from a control pannel indicated schematically at 23 through a cable 24.

With the marine transportation system of this embodiment, it will be understood that the specific weight of the tank 3 can be adjusted to almost equal that of the ambient sea water, by suitably filling the tank 3 with liquid fuel or other cargo. Therefore, the tank 3 is capable of maintaining its position in a state of equilibrium and can maintain itself horizontally so that the wave-resistance is kept to a minimum when the underwater cargo carrier C is being pulled by the tug boat. This means that the tank 3 may be pulled by minimum expenditure of energy, and it is also noted that since the tank 3 rotates as it is being pulled, the position of the tank 3 is quite stable owing to its inertia.

The cylindrical shape of the tank 3 provides the strength which makes it possible to dispense with the conventional double shell construction or stiffening walls required in the hulls of conventional tankers. Accordingly, a larger quantity of liquid fuel or other cargo may be accomodated in the strong and light tank 3 as compared to the hull of a conventional tanker for any given volume.

It will be understood that, since the tank 3 is self-propelled by the spiral fin 5, the engine 9 is required only to additionally propell the tug boat itself so that the engine of relatively small output horse power can effect the movement of both the surface vessel S and the cargo carrier C. It will be also understood that since the tug boat itself is not loaded with liquid fuel cargo extensive fire prevention and fire fighting equipment are not required for the tug boat and the trimming of the tug boat may be adjusted irrespective of the liquid fuel cargo carried by the carrier C. This makes it possible to reduce the number of crew aboard the surface vessel S. A fire on the liquid fuel cargo carrier can hardly ever occur, since the tank operates under water and does not involve equipment which may be the source of a fire, nor does it carry a medium which is likely to catch fire.

As described above, this embodiment of the present invention provides marine transportation in which a safe transportation of liquid fuel occurs on the sea by a relatively small crew. The tank is simple but strong in construction and is less expensive as compared to the hulls of conventional tankers, so accordingly it provides a highly economical transportation of liquid fuel as compared to prior marine transportation system.

Figure 3:
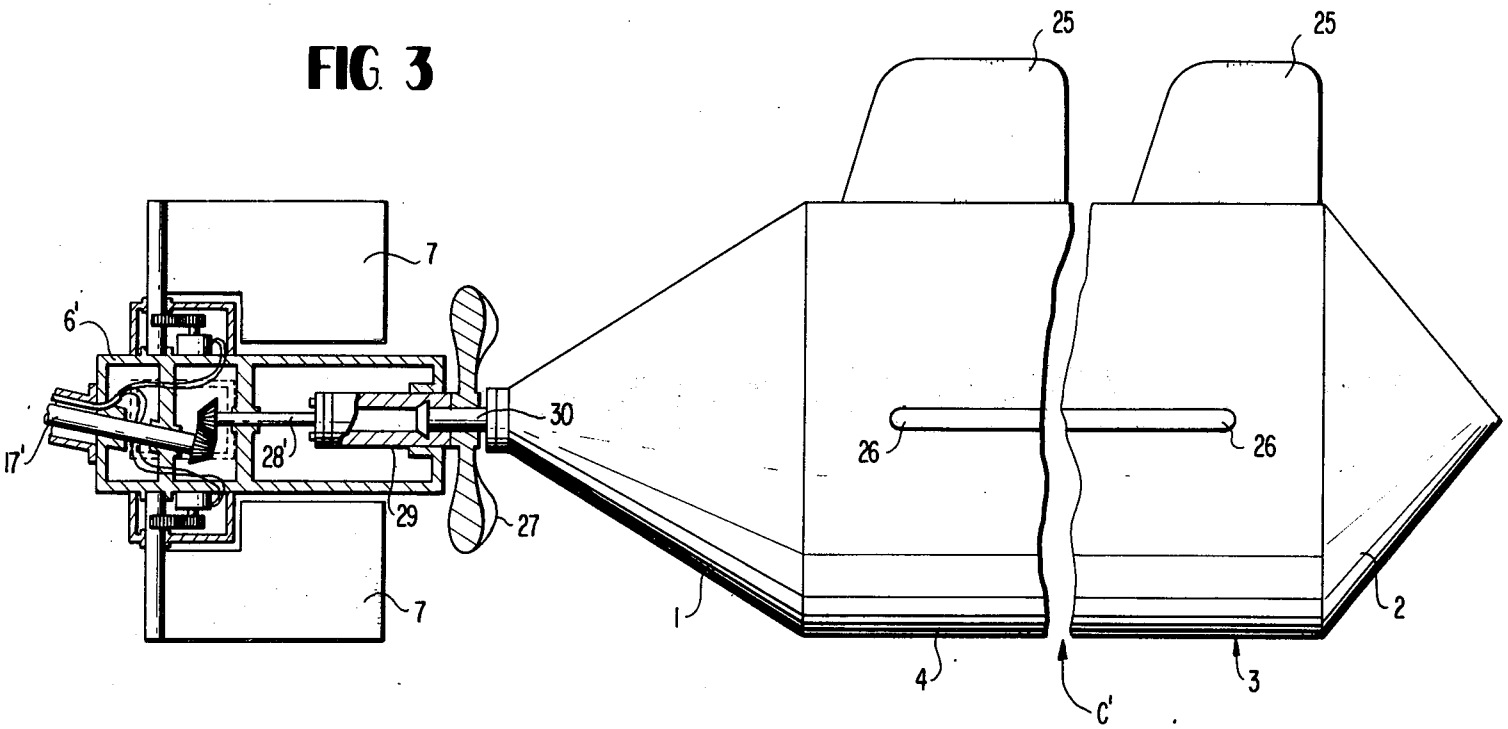
FIG. 3 is a partial sectional view of another embodiment of the cargo carrier of the marine transportation system shown in FIG. 1.

Referring to FIG. 3, an alternate embodiment of the invention is shown, wherein like elements to the embodiment of FIGS. 1 and 2 are given like numerical designations. The underwater cargo carrier C′ is equipped with vertical stabilizing fins 25 and horizontal fins 26 for preventing rolling and pitching, respectively, these elements being fixedly coupled to the exterior of the cylindrical central tank section 4. Further, in the manner of the prior embodiment, rudders 7 and 8 are provided and mounted to the nose portion 6′ of the cargo Carrier C′, and these are controlled in the same manner as the prior embodiment.

In this case, the shaft means for connecting the surface vessel and the cargo carrier C′ is also the same as the prior embodiment, however, the tank 3 of the underwater cargo carrier C′ does not rotate in the manner of the prior embodiment. Therefore, in this case, a propeller 27 is provided between the nose portion 6′ and the tank 3 and is driven by way of a shaft 29. Again, the tank 3 is provided with at least one cargo space and ballast tank (not shown) and the system is generally the same and operates in the same manner as the previous embodiment with the exception that the tank 3 does not rotate about its axis but, instead thereof, the propeller 27 rotates about its axis coincident with the axis 30 of the tank 3 to drive the tank through the water.

Figure 4:
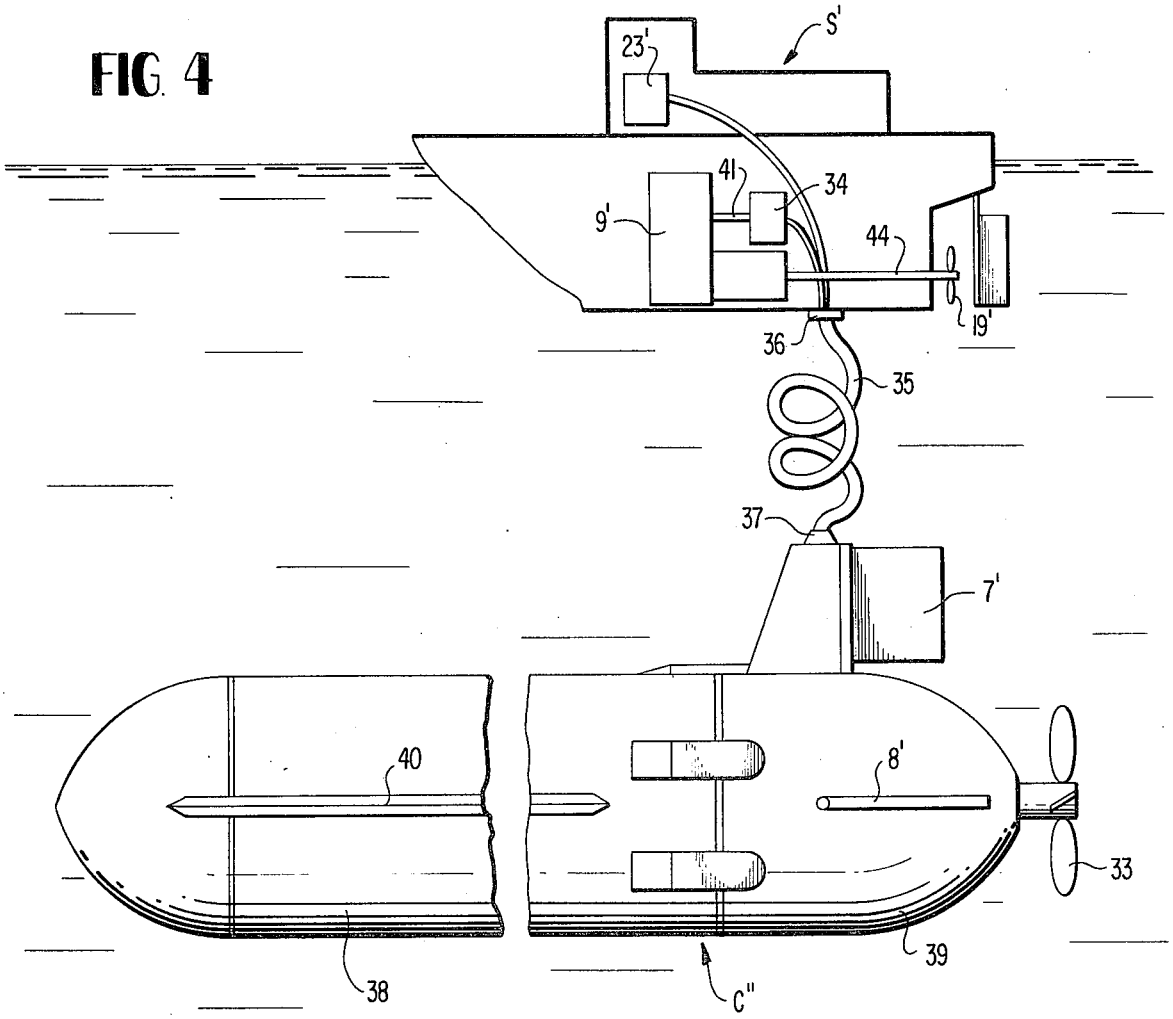
FIG. 4 is a schematic side elevational view of another embodiment of the present invention.
Figure 6:
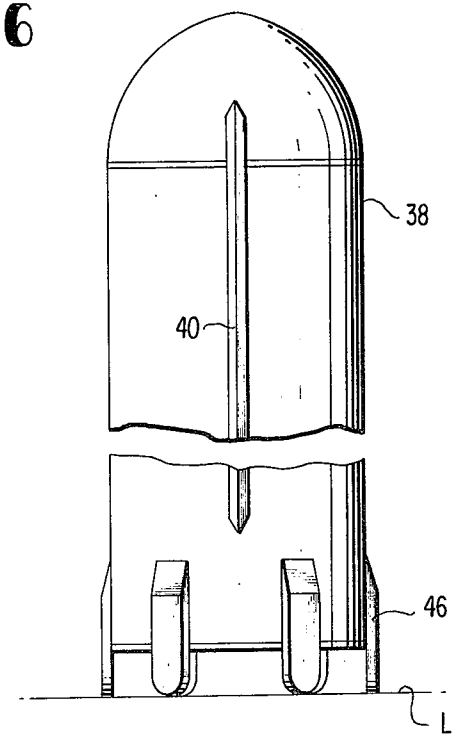
FIG. 6 is a vertical view of the cargo carrier separated from the propulsion section and resting on land.
Figure 5:
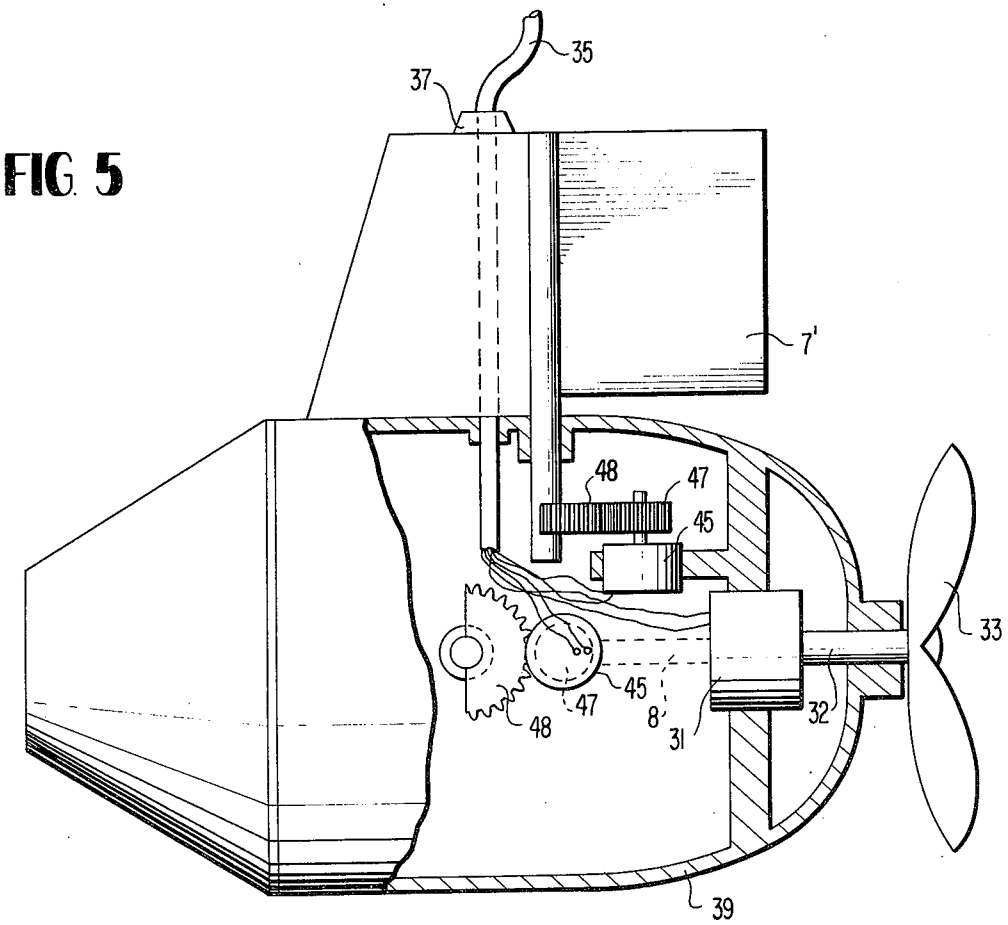
FIG. 5 is a partial sectional view of a portion of FIG. 4, showing the detachable bow section of the cargo carrier separated from the propulsion section.

Reference to FIGS. 4, 5 and 6, show another embodiment of the present invention, wherein the marine transport system comprises a surface ship S′ and an underwater or submarine cargo carrier C″. In this case the underwater cargo carrier C″ is propelled by an electric motor 31 which drives directly the shaft 32 to which propeller 33 is fixed. The motor 31 of the carrier C″ receives electrical energy from an engine driven generator 34 carried by the surface vessel S′. The surface vessel S′ is connected to the underwater cargo carrier C″ by an appropriate underwater cable 35 forming a waterproof connection for the electrical leads. The surface vessel S′ is equipped with a cable coupling or connector 36 while the underwater cargo carrier C″ has cable 35 terminating by way of coupling or connector 37. The underwater carrier C″ is driven by its own motor 31. Again, the carrier C″ is essentially a tank 3 of simple construction but being formed in two parts comprising a bow section 38 and a stern section 39. The cargo carrier C″ is provided with a steering rudder 7′ and a pair of flaps 8′ for controlling ascent and descent and is further provided with horizontal stabilizing fins 40. By constructing the main cargo section 38 detachable from the propelling section 39 it becomes possible to attach the propelling section 39 to a new cargo section 38 which has been loaded with cargo, thereby increasing the transportation efficiency of the surface vessel S′. The surface vessel S′ carries the electric power supply such as an engine driven generator 34, engine 9′ in this case directly driving the generator 34 by way of shaft 41, while the propeller 19′ of the surface vessel S′ is driven from the same engine by way of a shaft 44. This permits the generator to be driven by the same engine which drives the surface vessel S′ as desired. The rudder 7′ and flaps 8′ are driven by electrical motors 45 through gears 47 and 48. These are controlled in the same manner as described in the prior embodiment. The electrical power from the generator 34 is, as mentioned previously, fed to the cargo carrier C'' through common cable means 35.

As described above, the underwater carrier C'' is propelled by the motor 31 which is driven by electrical power supplied from the generator 34 of the surface vessel S' through the cable 35. The trim or position of the underwater cargo carrier C'' is controlled by its steering rudder 7', flaps 8' and so on, which are driven by the motors 45 which are operated by electrical signals supplied from the control pannel 23' through the same cable 35. Going ahead and going astern, port and starboard steering, submerging and raising of the craft as well as maintaining the cruising depth of the cargo carrier C'' is thus controlled by a minimal crew on the surface vessel S' whereby the underwater cargo carrier C'' can cruise by maintaining a suitable relative position with respect to the floating surface vessel S'. Since the cargo carrier C'' cruises underwater, it does not encounter wave making resistance, so that it may be propelled with minimum energy. The cylindrical construction of the hull of the underwater carrier C'' provides structural strength and relatively large volume in terms of cargo space.

Referring to FIG. 6 the bow or cargo section 38 separated from the propulsion section 39 constituting the stern section of the submarine craft is shown. Subsequent to removal of the bow section 38 from the stern or propulsion section 39, the bow section 38 can be readily raised from the water and stood on feet 46, thus orienting the cargo carrier vertically relative to the land L upon which it rests.

While the invention has been particularly shown and described with reference to preferred embodiments thereof, it will be understood by those skilled in the art that the forgoing and other changes in form and details may be made therein without departing from the sprite and scope of the invention.

What is claimed is:

1. A marine transportation system comprising a surface vessel, an underwater cargo carrier, said cargo carrier having an elongated cylindrical tank adapted to be filled with liquid fuel oil or the like, a propulsion means carried by said cargo carrier, a power source means carried by said surface vessel, and a power transport member mechanically interconnecting said carrier and said vessel for supplying power from said power source means to said propulsion means to effect self-propulsion of said underwater cargo carrier, said propulsion means comprising propeller means mounted on said tank, said power source means comprising an engine within said surface vessel and said power transport member comprising shaft means and universal joint means connecting said shaft means to said surface vessel engine and to said tank propeller means, respectively.

2. The marine transportation system as claimed in claim 1, wherein said propeller means comprises at least one spiral fin fixedly mounted to the external surface of said tank and wherein said tank is mounted by way of said universal joint means to said shaft means, whereby, said tank rotates about its axis driven by said shaft means connecting said surface vessel to said underwater cargo carrier.

* * * * *